US007254845B1

(12) United States Patent
Morad

(10) Patent No.: US 7,254,845 B1
(45) Date of Patent: Aug. 14, 2007

(54) TOILET SEAT COVER MADE OF A DISPOSABLE PAPER SHEET CONTAINING FINGER HOLES TO FACILITATE EASY TEARING OFF OF A CENTER PORTION OF THE SHEET

(75) Inventor: Fred I. Morad, Toluca Lake, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 0 days.

(21) Appl. No.: 11/479,465

(22) Filed: Jun. 30, 2006

(51) Int. Cl.
*A47K 13/14* (2006.01)
*A47K 13/16* (2006.01)

(52) U.S. Cl. ..... 4/245.3; 4/245.9

(58) Field of Classification Search ..... 4/245.1, 4/245.7, 245.8, 245.9, 244.1–244.3
See application file for complete search history.

(56) References Cited

U.S. PATENT DOCUMENTS

| | | | | |
|---|---|---|---|---|
| 1,248,077 | A | 11/1918 | Ennis | |
| 1,452,552 | A | 4/1923 | Frear | |
| 1,702,070 | A | 2/1929 | Young | |
| 1,761,391 | A | 6/1930 | Harris | |
| 1,847,131 | A * | 3/1932 | Moore | 4/244.1 |
| D174,213 | S | 3/1955 | Brito | |
| 3,851,341 | A * | 12/1974 | Aoyama | 4/245.4 |
| 4,120,343 | A * | 10/1978 | Wilson | 160/330 |
| 4,264,992 | A | 5/1981 | Tromp | |
| 4,766,617 | A | 8/1988 | Thygesen | |
| 4,875,242 | A | 10/1989 | Albrechet et al. | |
| D320,069 | S | 9/1991 | Rossiter | |
| D451,178 | S | 11/2001 | Massey | |
| 6,968,578 | B2 | 11/2005 | Bernsley | |

FOREIGN PATENT DOCUMENTS

| | | |
|---|---|---|
| EP | 0628278 | 12/1994 |
| WO | WO 99/34720 | 7/1999 |

* cited by examiner

*Primary Examiner*—Khoa D. Huynh
*Assistant Examiner*—Kristie A. Mahone
(74) *Attorney, Agent, or Firm*—Thomas I. Rozsa

(57) ABSTRACT

The present invention relates to a generally rectangular shaped disposable paper sheet for use as a toilet seat cover, comprising a die cut line shaped as an open ended oval, which divides the sheet into a central elongated ovally shaped portion and an outer seat covering portion. As one preferred embodiment, the present invention includes the addition of a pair of finger holes into the central portion of the paper sheet so that, when the finger holes are used to tear the die cut line, the entire central portion can be easily torn downwardly away from the outer covering portion which rests on and covers the toilet seat. In another preferred embodiment of the present invention, a reinforcement is applied around the finger holes to make them stronger so that they will not tear when the force of the fingers is applied to tear the die cut portion away from the seat cover portion.

16 Claims, 2 Drawing Sheets

TOILET SEAT COVER MADE OF A DISPOSABLE PAPER SHEET CONTAINING FINGER HOLES TO FACILITATE EASY TEARING OFF OF A CENTER PORTION OF THE SHEET

BACKGROUND OF THE INVENTION

1. Field of the Invention

The present invention is related to a disposable paper sheet used as a toilet seat cover for sanitary purpose.

2. Description of the Prior Art

The following 13 patents and published patent applications are the closest prior art references which are related to the present invention.

1. U.S. Pat. No. 1,284,077 issued to Luna May Ennis on Nov. 5, 1918 for "Sanitary Seat Cover For Toilets" (hereafter the "Ennis Patent");
2. U.S. Pat. No. 1,452,552 issued to Leo J. Frear on Apr. 24, 1923 for "Sanitary Seat Cover" (hereafter the "Frear patent");
3. U.S. Pat. No. 1,702,070 issued to Thomas L. Young on Feb. 12, 1929 for "Sanitary Toilet Seat Cover" (hereafter the "Young patent");
4. U.S. Pat. No. 1,761,391 issued to Clara F. Harris on Jun. 3, 1930 for "Sanitary Shield For Toilet Seats" (hereafter the "Harris patent");
5. U.S. Design Pat. No. Des. 174,213 issued to Jose Brito on Mar. 15, 1955 for "Disposable Paper Toilet Seat Cover" (hereafter the "Brito Design patent");
6. U.S. Pat. No. 4,264,992 issued to Geradus M. Tromp on May 5, 1981 for "Paper Sheet Cartridge" (hereafter the "Tromp patent");
7. U.S. Pat. No. 4,766,617 issued to Eskild G. Thygesen et al. on Aug. 30, 1988 for "Disposable Sanitary Toilet Seat Cover" (hereafter the "Thygesen patent");
8. U.S. Pat. No. 4,875,242 issued to Leonard N. Albrecht et al. and assigned to Alvin S. Haining et al. on Oct. 24, 1989 for "Compact Toilet Seat Cover" (hereafter the "Albrecht patent");
9. U.S. Design Pat. No. Des. 320,069 issued to Jean T. Rossiter on Sep. 17, 1991 for "Toilet Seat Cover" (hereafter the "Rossiter Design patent");
10. U.S. Design Pat. No. D451,178 issued to William Yates Massey, Jr. on Nov. 27, 2001 for "Portable Toilet Seat Cover" (hereafter the "Massey Design patent");
11. U.S. Pat. No. 6,968,578 issued to Mark Bernsley on Nov. 29, 2005 for "Child's Disposable Toilet Seat Adaptor With Side Handles And Fold-Under Flap" (hereafter the "Bernsley patent");
12. European Patent Application No. 0,628,278 issued to Walter J. Breyer and assigned to Scott Paper Company on Dec. 14, 1994 for "Flushable, Laminated Toilet Seat Cover" (hereafter the "Breyer European Patent Application");
13. International application No. WO 99/34720 issued to Josef Kodet et al. on Jul. 15, 1999 for "Sanitary Toilet Seat Cover" (hereafter the "Kodet International Application").

The Ennis patent which issued in 1918 is a seat cover for toilets. It discloses slot cut portions B which can be used to separate the center section from the body of the cover.

The Frear patent which issued in 1923 is also a roll of sanitary covers which is attached to the toilet and which can be pulled by tabs 8 to remove one seat cover from the roll of seat covers.

The Young patent which issued in 1929 is a sanitary toilet seat cover which has flaps which are designed to hang onto the interior of the bowl to facilitate the carrying away of the cover in the flushing operation.

The Harris patent which issued in 1930 is also a sanitary cover. It discloses a use of tabs 20 by which the seat cover may be removed from the toilet seat after use.

The Brito patent which issued in 1955 is a design patent which protects the shape of a toilet seat cover.

The Tromp patent is a paper sheet cartridge which discloses having longitudinally extending slits 35 and 37 forming a curve out of portion 39 and a central tongue 41. There are two slits 57 and 58 shown but these don't serve any functional purpose.

The Thygesen patent which issued in 1988 discloses a disposable sanitary toilet seat cover. It discloses a finger hole 6 which can be used for gripping in the process of tearing off the central potion. However, the disadvantage of the Thygesen invention is that the finger hole is located on the edge of the central portion which is bounded by a die cut line, wherein a part of the edge of the finger hole is aligned with the die cut line. Therefore, the finger hole disappears once it is used to tear a portion of the interior section of the die cut line away from the remainder of the toilet seat cover.

The Albrecht patent discloses a compact toilet seat cover which includes a small piece of tape 58 and a protective liner 62.

The Rossiter patent discloses the design for a toilet seat cover.

The Massey patent is a design patent, which discloses a portable toilet seat cover. There is a groove which is shown at the bottom but is unclear what purpose it serves.

The Bemsley patent is a disposable toilet seat cover which has more of a solid cover designed so that a child can sit in the toilet and not fall in.

The Breyer European Patent Application discloses a flushable toilet seat cover which can dissolve when it falls into the toilet seat.

Finally, the Kodet International Patent Application discloses a sanitary toilet seat cover which consists of two water soluble layers so that it can dissolve in the toilet.

There is a significant need to significantly improve the ability to tear away the center portion of a die cut toilet seat cover.

SUMMARY OF THE INVENTION

The present invention relates to a generally rectangular shaped disposable paper sheet for use as a toilet seat cover, comprising a die cut line shaped as an open ended oval, which divides the sheet into a central elongated ovally shaped portion and an outer seat covering portion. More particularly, the present invention, as one preferred embodiment, relates to the addition of a pair of finger holes into the central portion of the paper sheet so that, when the finger holes are used to tear the die cut line, the entire central portion can be easily torn downwardly away from the outer covering portion which rests on and covers the toilet seat. In another preferred embodiment of the present invention, a reinforcement is applied around the finger holes to make them stronger so that they will not tear when the force of the fingers is applied to tear the die cut portion away from the seat cover portion.

It has been discovered, according to the present invention, that if a pair of finger holes are placed into a central elongated ovally shaped portion of a generally rectangular paper sheet which is used as a toilet seat cover, wherein the central portion is bounded by a die cut line shaped as an open ended oval and the paired holes are placed transversely to an imaginary centerline of the sheet, the central portion of the sheet will be more easily and entirely torn along the die cut line, when the paired finger holes are used to tear the center portion away from the outer seat covering portion.

It has also been discovered, according to the present invention, that if the paired finger holes placed into the central portion of the sheet are reinforced around the holes, it makes the reinforced finger holes stronger so that they will not tear when force is applied to the holes.

It has been additionally discovered, according to the present invention, that if at least one finger hole is placed into a central portion of a generally rectangular paper sheet which is used as a toilet seat cover, wherein the central portion is determined by a die cut line shaped as an open ended oval and the hole is placed adjacent an imaginary centerline of the elongated sheet, the central portion of the sheet will be more easily and entirely torn from the die cut line when a finger is inserted into at east one hole and to tear the central portion away from the covering portion.

It has further been discovered, according to the present invention, that if the at least one finger hole placed into the central portion of the sheet is reinforced around the hole, it makes the reinforced finger hole stronger so that it will not tear.

It is therefore an object of the present invention to provide a pair of finger holes placed into a central elongated ovally shaped portion of a generally rectangular paper sheet which is used as a toilet seat cover, wherein the central portion is bounded by a die cut line shaped as an open ended oval and the paired holes are placed transversely to an imaginary centerline of the sheet so that the central portion of the sheet will be more easily and entirely torn along the die cut line when the paired finger holes are used to tear center portion away from the outer seat covering portion.

It is also an object of the present invention to provide reinforcement around the pair of finger holes which are placed into the central portion of the sheet, to thereby make the reinforced finger holes stronger so that they will not tear when force is applied to the holes.

It is an additional object of the present invention to provide at least one finger hole placed into a central portion of a generally rectangular paper sheet which is used as a toilet seat cover, wherein the central portion is bounded by a die cut line shaped as an open ended oval and the hole is placed adjacent an imaginary centerline of the elongated sheet so that the central portion of the sheet may be more easily and entirely torn from the die cut line, when the at least one finger hole is used to tear the central portion away from the outer seat covering portion.

It is a further object of the present invention to provide reinforcement around the least one finger hole which is placed into the central portion of the sheet to thereby make the reinforced finger hole stronger so that it will not tear.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is an improvement to resolve deficiencies in prior art toilet seat covers by adding a pair of finger holes into a central portion of a die cut paper sheet which is used as a toilet seat cover to enable the central portion to be effectively gripped by insertion of one of two fingers of a hand into a respective finger hole to apply a force to the sheet so that the entire central portion can be easily and quickly torn away from rest of the sheet.

Figure 1:
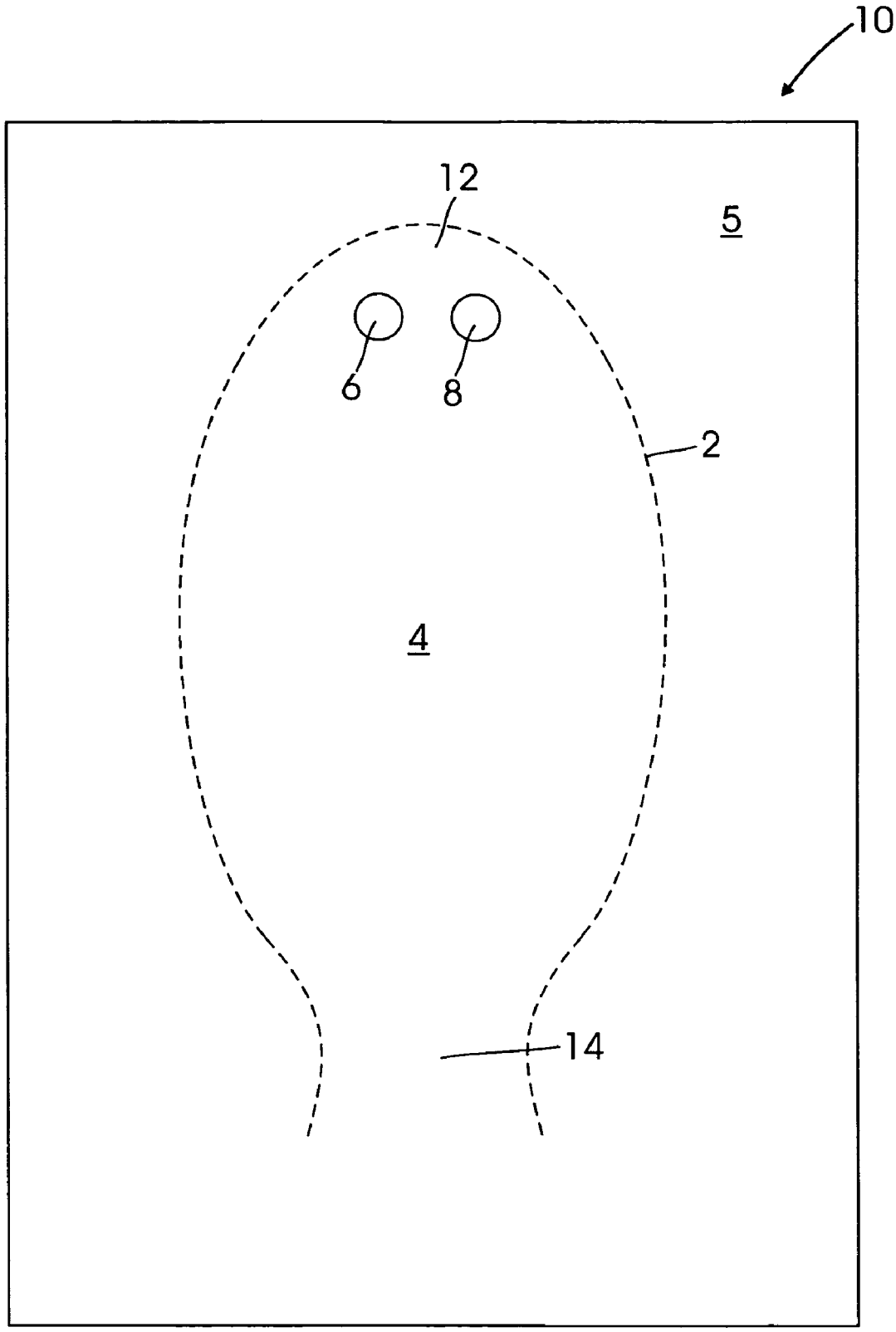
FIG. 1 is a plan view of the present invention paper sheet for use as a toilet seat cover according to an embodiment of the invention wherein a pair of finger holes are placed into a central portion of the sheet.

Referring to FIG. 1, there is illustrated one preferred embodiment of the present invention improved disposable paper sheet used as a toilet seat cover wherein the improvement is the addition of finger holes in the central portion which lies within the die cut area to facilitate easily tearing off of the central portion from the remainder of the sheet. In a preferred embodiment, the sheet 10 has a generally rectangular shape, comprising a die cut line 2 shaped as an open ended oval, wherein the die cut line comprises a plurality of fine discrete slits with a fine distance between two adjacent slits. The die cut line 2 further defines a central elongated ovally shaped portion 4, and an outer seat covering portion 5 of the paper sheet 10. The central portion comprises an oval area 12 and a distal section 14 along a longitudinal direction of the elongated ovally shaped central portion 4.

Referring further to FIG. 1, a pair of finger holes 6 and 8 are preferably located transversely and symmetrically along an imaginary centerline of the elongated central portion 4, wherein the imaginary centerline is further aligned with a longitudinal centerline of the rectangular sheet 10. The pair of finger holes 6 and 8 are further illustrated to preferably be located close to the oval end 12 of the central portion 4. With the presence of the finger holes, the user can grip the finger holes 6 and 8 by placing a respective one of two fingers into a respective finger hole and apply a force to separate the entire central elongated ovally shaped portion 4 away from the outer seat covering portion 5 through tearing the die cut line 2. The outer seat covering portion then can be placed to rest on and cover the toilet seat, while the central portion 4 with the oval end 12 extends downwardly into a toilet bowl while the distal section 14 links the central portion 4 to the outer seat covering portion 5. The central elongated ovally shaped portion also serves to carry the sheet off when the toilet is flushed, wherein the paper sheet used in the present invention is a preferred type suitable for flushing after use so that the entire paper sheet can be disposed of into the toilet.

Figure 2:
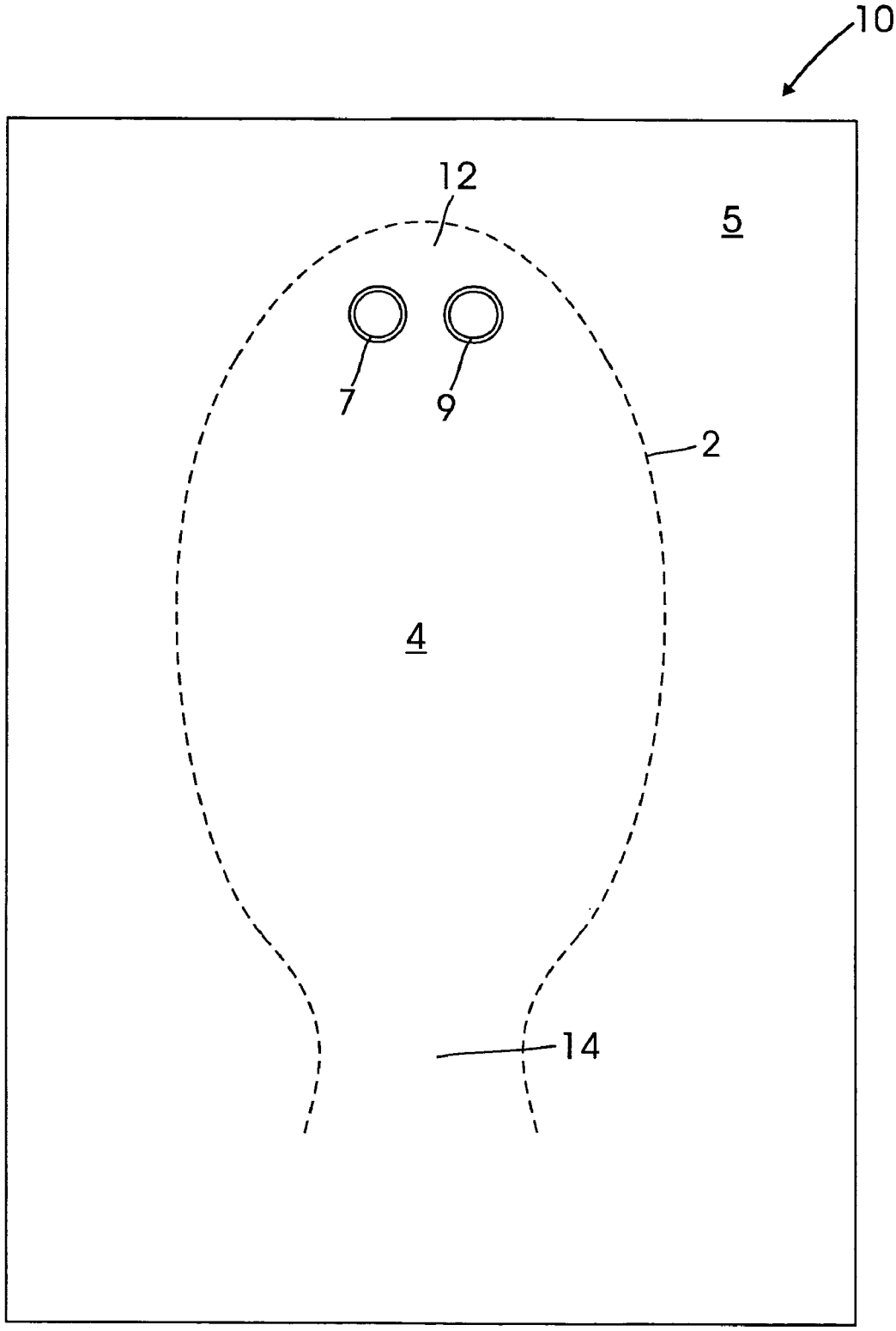
FIG. 2 is a plan view of the present invention paper sheet for use as a toilet seat cover according to an another embodiment of the invention wherein a pair of finger holes with reinforcements around the holes are placed into a central portion of the sheet.

Referring to FIG. 2, there is illustrated an another preferred embodiment of the present invention. As illustrated, a reinforcement is applied around each of the paired holes, which makes the reinforced finger holes 7 and 9 stronger, so that they will not tear when the force is applied to the holes.

It will be appreciated that the reinforcement to the finger holes can be achieved through mechanical and chemical methods. As an example of a mechanical reinforcement, additional layers of the same type or different types of paper sheets can be added onto areas around the finger holes. As an example of chemical reinforcement, a plastic film can be coated onto the paper sheet around the finger holes.

It will be further appreciated that the reinforcement not only can be separately applied to each respective finger hole, but also can be applied to both finger holes so that the reinforcement can be an integral part of the toilet seat cover.

It will be additionally appreciated that the presently invented paper sheet for use as the toilet seat cover is not limited to be the rectangular shape. For example, an annular shape is also effective. Any shape of the paper sheet can be effective for the present invention as long as the outer seat covering portion can rest on and cover the toilet seat. For the same reason, the central portion of the paper sheet is not limited to be the oval shape but can be any appropriate shapes, such as a "U" shape.

It will be further appreciated that pair of finger holes are not limited to be located close to the oval end of the central portion of the paper sheet. The finger holes can be located at any location in the central portion 4 as long as the central portion can be easily and quickly torn from the outer seat covering portion 5 when the finger holes are used for the tearing purpose. The finger holes should be in the body portion 4 and not adjacent the die-cut 2 because placing the holes adjacent to the die-cut will cause the hole to disappear once the central portion 4 is torn away from the die-cit 2.

It will also be appreciated that it is within the spirit and scope of the present invention to have at least one finger hole in the central portion 4 to effectively separate the central portion 4 from the outer seat covering portion 5 of the paper sheet 10.

Defined in detail, the present invention is a paper sheet used as a toilet seat cover, comprising: (a) a generally rectangular shaped sheet of paper which is suitable for flushing into a toilet after use and having a die cut line shaped as an oval that divides the paper sheet into a central elongated ovally shaped portion and an outer seat covering portion; (b) the central elongated ovally shaped portion comprises an oval area and a distal section, with a pair of spaced apart finger holes transversely extending through the oval area and symmetrically located along an imaginary longitudinal centerline of the oval area and further close to an end of the oval area remote from the distal section, the imaginary longitudinal centerline is further aligned with a longitudinal centerline of the paper sheet; and (c) through use of a respective one of two fingers of a hand, the fingers are respectively inserted into a respective one of the finger holes and used to tear the oval area along the die-cut line to separate the oval area from the remainder of the sheet, so that when the covering portion is placed over a toilet seat, the elongated oval area hangs down into a toilet bowl and remains connected to the covering section by its distal section.

Defined more broadly, the present invention is a paper sheet used as a toilet seat cover, comprising: (a) a sheet of paper having an interior die cut line which divides the paper sheet into a central portion within the die-cut line and an outer seat covering portion; (b) the central portion comprises a body area and a distal section, with a pair of spaced apart finger holes transversely extending through the body area; and (c) through use of a respective one of two fingers of a hand, the fingers are inserted into a respective one of the finger holes and used to tear the body area along the die-cut line to separate the body area from the remainder of the sheet, so that when the covering portion is placed over a toilet seat, the body area hangs down into a toilet bowl and remains connected to the covering section by its distal section.

Defined most broadly, the present invention is a paper sheet used as a toilet seat cover, comprising: (a) a sheet of paper having an interior die cut line which divides the paper sheet into a central portion within the die-cut line and an outer seat covering portion; (b) the central portion comprises a body area and a distal section, with at least one finger hole transversely extending through the body area; and (c) through use of a finger of a hand, the finger is inserted into the at least one finger hole and used to tear the body area along the die-cut line to separate the body area from the remainder of the sheet, so that when the covering portion is placed over a toilet seat, the body area hangs down into a toilet bowl and remains connected to the covering section by its distal section.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A paper sheet used as a toilet seat cover, comprising:

a. a generally rectangular shaped individual sheet of paper which is suitable for flushing into a toilet after use and having a die cut line shaped as an oval that divides the paper sheet into a central elongated ovally shaped portion and an outer seat covering portion;

b. said central elongated ovally shaped portion comprises an oval area and a distal section, with a pair of spaced apart finger holes transversely extending through the oval area and symmetrically located along an imaginary longitudinal centerline of the oval area and further close to an end of the oval area remote from the distal section, the pair of spaced apart finger holes positioned at a location so that the finger holes are not connected to the die cut line and do not touch the die cut line, said imaginary longitudinal centerline is further aligned with a longitudinal centerline of said paper sheet; and c. through use of fingers of a hand, the fingers are respectively inserted into a respective one of the finger holes and used to tear the oval area along the die-cut line to separate the oval area from the remainder of the sheet, so that when the covering portion is placed over a toilet seat, the elongated oval area hangs down into a toilet bowl and remains connected to the covering section by its distal section.

2. A toilet seat cover in accordance with claim 1 wherein each finger hole is reinforced to provide extra strength.

3. A toilet seat cover in accordance with claim 2 wherein the reinforcement is more than one sheet of paper at the location of each finger hole.

4. A toilet seat cover in accordance with claim 2 wherein the reinforcement is a plastic coating at the location of each finger hole.

5. A paper sheet used as a toilet seat cover, comprising:

a. an individual sheet of paper having an interior die cut line which divides the paper sheet into a central portion within the die-cut line and an outer seat covering portion;

b. said central portion comprises a body area and a distal section, with a pair of spaced apart finger holes transversely extending through the body area and positioned at a location so that the finger holes are not connected to the die cut line and do not touch the die cut line; and c. through use of fingers of a hand, the fingers are inserted into a respective one of the finger holes and used to tear the body area along the die-cut line to separate the body area from the remainder of the sheet, so that when the covering portion is placed over a toilet seat, the body area hangs down into a toilet bowl and remains connected to the covering section by its distal section.

6. A toilet seat cover in accordance with claim 5 wherein the two finger holes are symmetrically located within the body area along an imaginary longitudinal centerline of the body area.

7. A toilet seat cover in accordance with claim 5 wherein each finger hole is reinforced to provide extra strength.

8. A toilet seat cover in accordance with claim 7 wherein the reinforcement is more than one sheet of paper at the location of each finger hole.

9. A toilet seat cover in accordance with claim 7 wherein the reinforcement is a plastic coating at the location of each finger hole.

10. A toilet seat cover in accordance with claim 5, wherein said pair of finger holes are located at any location of the body area so as not to touch the die-cut line.

11. A paper sheet used as a toilet seat cover, comprising:

a. an individual sheet of paper having an interior die cut line which divides the paper sheet into a central portion within the die-cut line and an outer seat covering portion;

b. said central portion comprises a body area and a distal section, with at least one finger hole transversely extending through the body area and positioned at a location so that the finger holes are not connected to the die cut line and do not touch the die cut line; and c. through use of a finger of a hand, the finger is inserted into the at least one finger hole and used to tear the body area along the die-cut line to separate the body area from the remainder of the sheet, so that when the covering portion is placed over a toilet seat, the body area hangs down into a toilet bowl and remains connected to the covering section by its distal section.

12. A toilet seat cover in accordance with claim 11 wherein the at least one finger hole is located within the body area along an imaginary longitudinal centerline of the body area.

13. A toilet seat cover in accordance with claim 11 wherein the at least one finger hole is reinforced to provide extra strength.

14. A toilet seat cover in accordance with claim 13 wherein the reinforcement is more than one sheet of paper at the location of the at least one finger hole.

15. A toilet seat cover in accordance with claim 13 wherein the reinforcement is a plastic coating at the location of the at least one finger hole.

16. A toilet seat cover in accordance with claim 13, wherein the at least one finger hole is located at any location of the body area so as not to touch the die-cut line.

* * * * *